US005410860A

United States Patent [19]

Coudray et al.

[11] Patent Number: 5,410,860

[45] Date of Patent: May 2, 1995

[54] INSERTING DEVICE FOR INSERTING DOCUMENTS INTO AN ENVELOPE

[75] Inventors: Gérard Coudray, Andrésy; Hervé Baumann, Paris, both of France

[73] Assignee: Secap, France

[21] Appl. No.: 308,072

[22] Filed: Sep. 16, 1994

[30] Foreign Application Priority Data

Sep. 22, 1993 [FR] France ..... 93 11273

[51] Int. Cl.[6] ..... B65B 43/26; B65B 43/34

[52] U.S. Cl. ..... 53/569; 53/381.5

[58] Field of Search ..... 53/569, 284.3, 381.5, 53/206, 381.7

[56] References Cited

U.S. PATENT DOCUMENTS 3,423,900 1/1969 Orsinger ..... 53/29
3,872,649 3/1975 Wimmer ..... 53/569
4,020,615 5/1977 Irvine ..... 53/35
4,525,986 7/1985 Noll ..... 53/569
4,888,938 12/1989 Auerbach .

*Primary Examiner*—John Sipos
*Assistant Examiner*—Rodney A. Butler
*Attorney, Agent, or Firm*—St. Onge Steward Johnston & Reens

[57] ABSTRACT

An apparatus is disclosed for inserting a document into an envelope. The apparatus comprises a rotating assembly which includes a document tranferring means. In first position of the rotating assembly, an envelope is fed and a document is fed to the transferring means. While the assembly is rotated to a second position, the document is being conveyed to the envelope and inserted therein. The envelope is then discharged and the assembly is rotated back to its first position.

5 Claims, 4 Drawing Sheets

INSERTING DEVICE FOR INSERTING DOCUMENTS INTO AN ENVELOPE

BACKGROUND OF THE INVENTION

The instant invention relates to inserting machines for inserting into an envelope documents which have been folded first and more particularly to office folding-inserting devices.

Up to now, most of the inserting systems, such as those shown in U.S. Pat. Nos. 4,020,615 and 4,888,938, have been operating according to the same basic principle. The empty envelope is always stopped when the document is inserted into the envelope.

As a result of this method, processing speed is noticeably diminished since the envelope must be stopped during the insertion of the document.

Some collecting-inserting machines, such as that shown in U.S. Pat. No. 3,423,900, have been developed, in which the envelopes do not stop during the insertion of the document, but they are generally cumbersome and bulky, and are not intended to be compact office inserters.

It is an object of the invention to provide a compact inserting device avoiding the above drawbacks and permitting insertion of a document while the envelope is being moved.

SUMMARY OF THE INVENTION

The instant invention provides an apparatus for inserting a document into an envelope, cooperating with document delivering means for delivering documents, envelope delivering means for delivering envelopes and envelope collecting means for collecting and discharging envelopes. The apparatus further comprises:

a rotating assembly displaceable between an envelope receiving position and an envelope discharging position, said rotating assembly comprising an envelope receiving station and a document receiving station as well as a transferring means for transferring a document between the document receiving station and the envelope receiving station, the envelope receiving station and the document receiving station being located respectively in front of the envelope delivering means and the document delivering means when the rotating assembly is in the envelope receiving position, the envelope receiving station being located in front of the envelope collecting means when the rotating assembly is in the envelope discharging position, control means being provided for achieving the following movement cycle:

a) the rotating assembly being in the envelope receiving position, the document delivering means and envelope delivering means are actuated, as well as the document transferring means between the document receiving station and the envelope receiving station, b) the rotating assembly rotates from the envelope receiving position to the envelope discharging position, while the transferring means is still operated, c) the rotating assembly being in the envelope discharging position, the envelope collecting means is operated, d) the rotating assembly is brought back to the envelope receiving position, The transfering means can be designed in different manners: sets of pulleys, belts and the like, optionally associated with guide means which are stationary with respect to the rotating assembly. Preferably, it includes at least a set of parallel endless belts cooperating with a drum which engages one side of the belts so as to drive frictionally a document pinched between the said belt sides and the drum. Advantageously, only the belts are driven while the drum is idle.

The document receiving station is for example defined by stationary guiding means (with respect to the rotating assembly), such as guiding plates, which lead the document delivered by the document delivering means towards the entrance of the transferring means.

The envelope receiving station includes two moveable gripping and guiding fingers whose distance therebetween is timely controlled in relation to the steps of the inserting cycle through the control means. The envelope delivering means brings the envelope onto these fingers in open position; the inside of the envelope is located downstreams of the document transferring means, and the fingers can advantageously serve as guides for the document during its insertion into the envelope.

The rotating assembly includes two side plates between which the shafts supporting the various rotating members of the device are mounted. These side plates are themselves mounted rotatably with respect to stationary plates of a frame and can be rotated through appropriate means.

The document delivering means, envelope delivering means and envelope collecting means are located at fixed stations adjacent to the rotating assembly and are circumferentially offset with respect to one another. They advantageously consist in pressing rollers.

During the rotation of the rotating assembly for step b of the moving cycle, it its advantageous to retract or shift away the envelope collecting means at least partially (for example, one of the pressing rollers) so that the envelope passed around the gripping fingers can freely come to its discharge position.

The control means controls and synchronizes the driving motors for all the moveable elements: delivering and discharging means, transferring means, moveable fingers, rotating assembly. It preferably includes a microprocessor.

BRIEF DESCRIPTION OF THE DRAWINGS

FIG. 2: bringing the envelope and the document;

FIG. 3: passing the envelope around the gripping fingers and introducing the document into the transferring means;

FIG. 4: beginning rotation of the rotating assembly;

FIG. 5: ending rotation of the rotating assembly;

FIG. 6: gripping of the envelope by the envelope collecting means;

FIG. 7: discharging the envelope.

DETAILED DESCRIPTION

Figure 1:
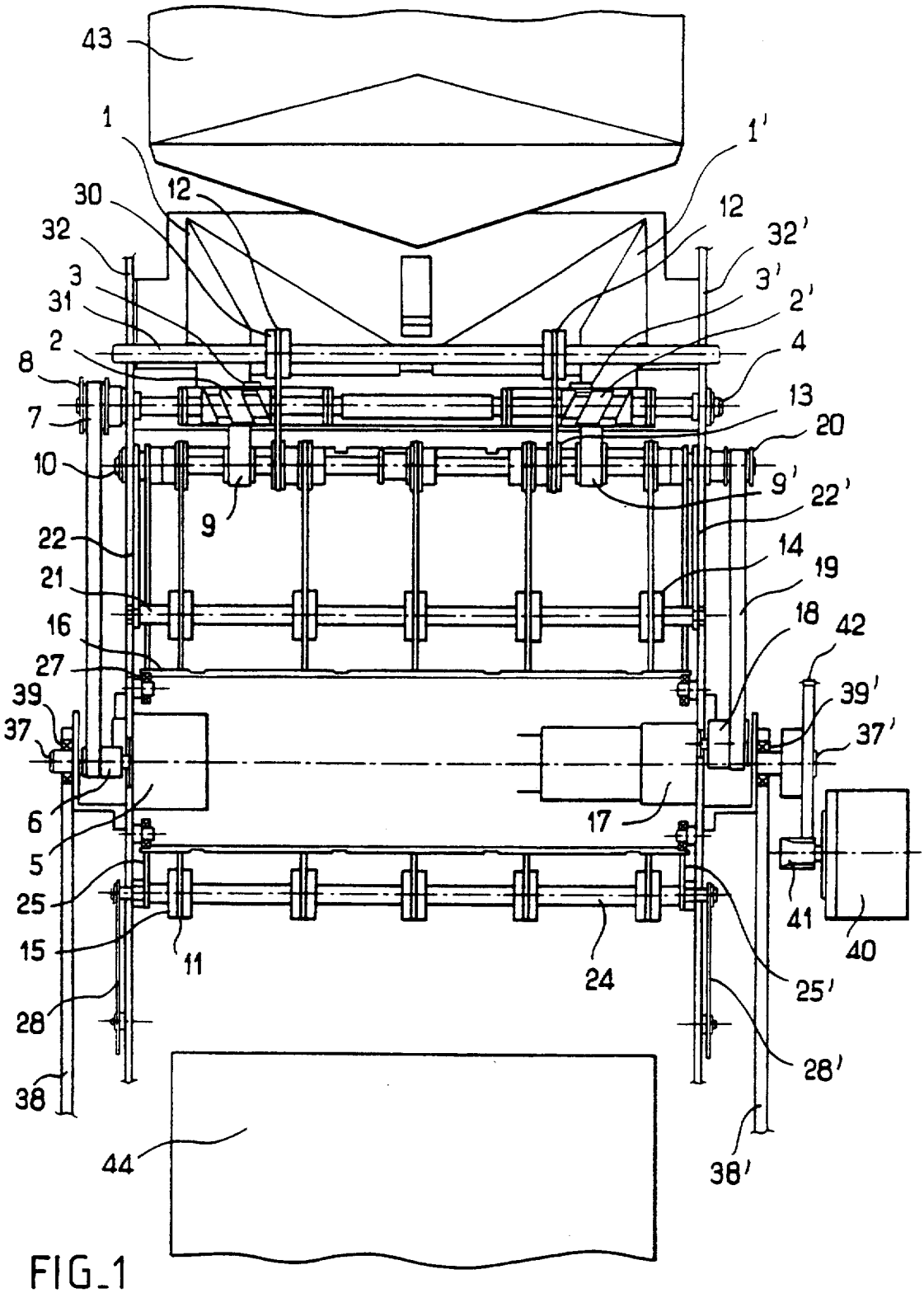
FIG. 1 is an overall developed sectional view of an inserter made in accordance with the invention, taken on the path of an envelope.

The inserter comprises a pair of symmetrical fingers 1, 1', made in bended metal sheet and defining the envelope receiving station. The external configuration of the fingers is such that they can introduce themselves into the envelope. The inner configuration of the fingers allows guiding of the documents to be inserted into the envelope. The fingers 1, 1' have a sheet flange with a spigot 3, 3' engaging the threads of screws 2, 2' secured on a shaft 4. The threads of the screws 2, 2' have the same pitch but are in opposite direction. Rotating the shaft 4 entails, through the screws 2, 2' and the spigots 3, 3' simultaneous sliding movement of the fingers 1, 1' in opposite directions. The rotation of the shaft 4 is achieved by a step motor 5 via a set of pulleys 6, 8 and notched belt 7. For avoiding pivoting movement of the fingers 1, 1' about the shaft 4, they have a sheet flange 9, 9' engaging a shaft 10 parallel to the shaft 4.

Figure 2:
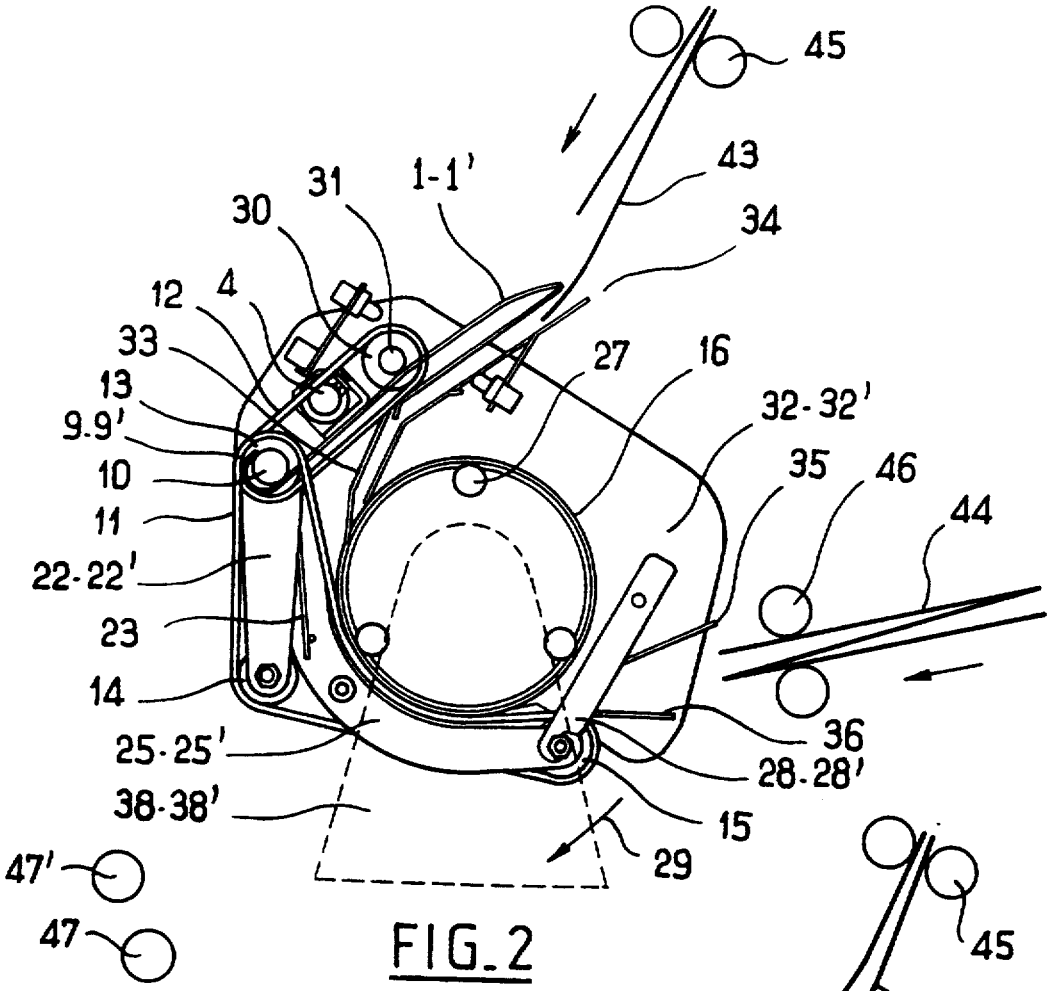
FIGS. 2, 3, 4, 5, 6 and 7 show side views of the inserter of FIG. 1 at different stages of the operating cycle of the inserter, respectively.

The transferring means for transferring the document towards the envelope is defined by the round belts 11 and 12. Five round belts 11 are wound on pulleys 13, 14 and 15 and on a drum 16 parallel to the shaft 4. Seven pulleys 13 are secured on the shaft 10. They are rotated by a motor 17 via the set of pulleys 18, 20 and belt 19. Five pulleys 14 are mounted idle on a shaft 21 parallel to the shafts 4 and 10. The shaft 21 is supported by two tensioning arms 22, 22' pivoting on the shaft 10. The tension load is assured by a pin wire spring 23. The five pulleys 15 are mounted idle on a shaft 24 parallel to the shaft 4 and supported by two arms 25, 25' pivoting on the shaft 10. The drum 16 is rotatably mounted on two sets of three bearings 27. Latches 28, 28' can maintain the shafts 24 in a fixed position. Release of the latches permits complete opening of the belt path 11 along the arrow 29 (FIG. 2). The two round belts 12 are wound on the pulleys 13 and pulleys 30 which are mounted idle on a shaft 31.

The above-mentioned mechanical parts are mounted in a box structure formed by two identical parallel side plates 32, 32' (FIGS. 1 and 2), and transversal metal sheets 33, 34, 35 and 36 (FIG. 2). These sheets ensure also the guiding of the envelope or the document during the inserting phase.

The plates 32, 32' have to identical journals 37, 37' by means of which they journal with respect to stationary side plates 38, 38' through bearings 39, 39'. Rotation of the rotating assembly is obtained through a step motor 40 and gears 41, 42.

The different stages for inserting a document into an envelope will now be described with reference to FIGS. 2 to 7.

In FIG. 2, the inserter is in its high position or envelope receiving position; the fingers 1, 1' are in side by side relationship. The envelope 43 is brought by an envelope delivering means 45, located upstreams of the inserting devices. The envelope delivering means 45 introduces the envelope flap between the pair of fingers 1, 1' and the transversal sheet or plate 34. The partial opening of the envelope, necessary for the envelope to cover the fingers, has been obtained in the envelope delivering means 45. The document 44 to be inserted is made to move by one of the rollers of the document delivering means 46.

Figure 3:
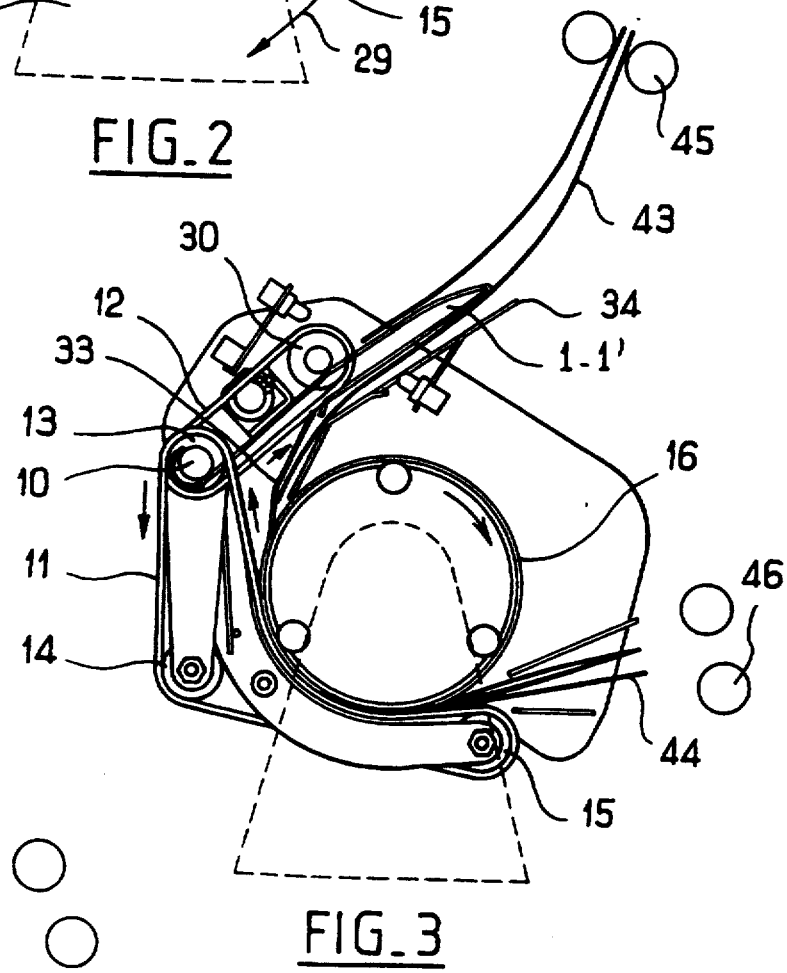

FIG. 3 shows the following step. The envelope is engaged by the envelope delivering means 45 onto the fingers 1, 1'. The flap and the envelope portion adjacent to the flap are introduced between the bottom edge of the fingers 1, 1', the sheet 33 and the sheet 34. Due to the engaging shape of the fingers 1, 1', the other side of the envelope is readily coming on the top portion of the fingers 1, 1'. When total engagement is achieved, the microprocessor triggers clamping of the fingers outwardly against the inner edges of the envelope. This operation is obtained through the action of the step motor 5 which controls the sliding movement of the fingers 1, 1'through the set pulleys-belt 6, 7, 8, the shaft 4 and the screws 2, 2'. As soon as this step begins, the microprocessor further triggers the transferring step of the document through the inserting device. For that purpose, the D.C. motor 17 sets in rotation the five conveying belts 11 and the two conveying belts 12 via the set pulleys-belt 18, 19, 20, the shaft 10 and the pulleys 13, 14, 15 and 30. As a result of the engagement of the belts 11 with the drum 16, the rotation of the belts drives the drum 16 in rotation. The document delivering means 46 delivers the document 44. The transversal plates 35 and 36 guide the document towards the conveying means 11. The document is then pinched between these belts 11 and the drum 16.

Figure 4:
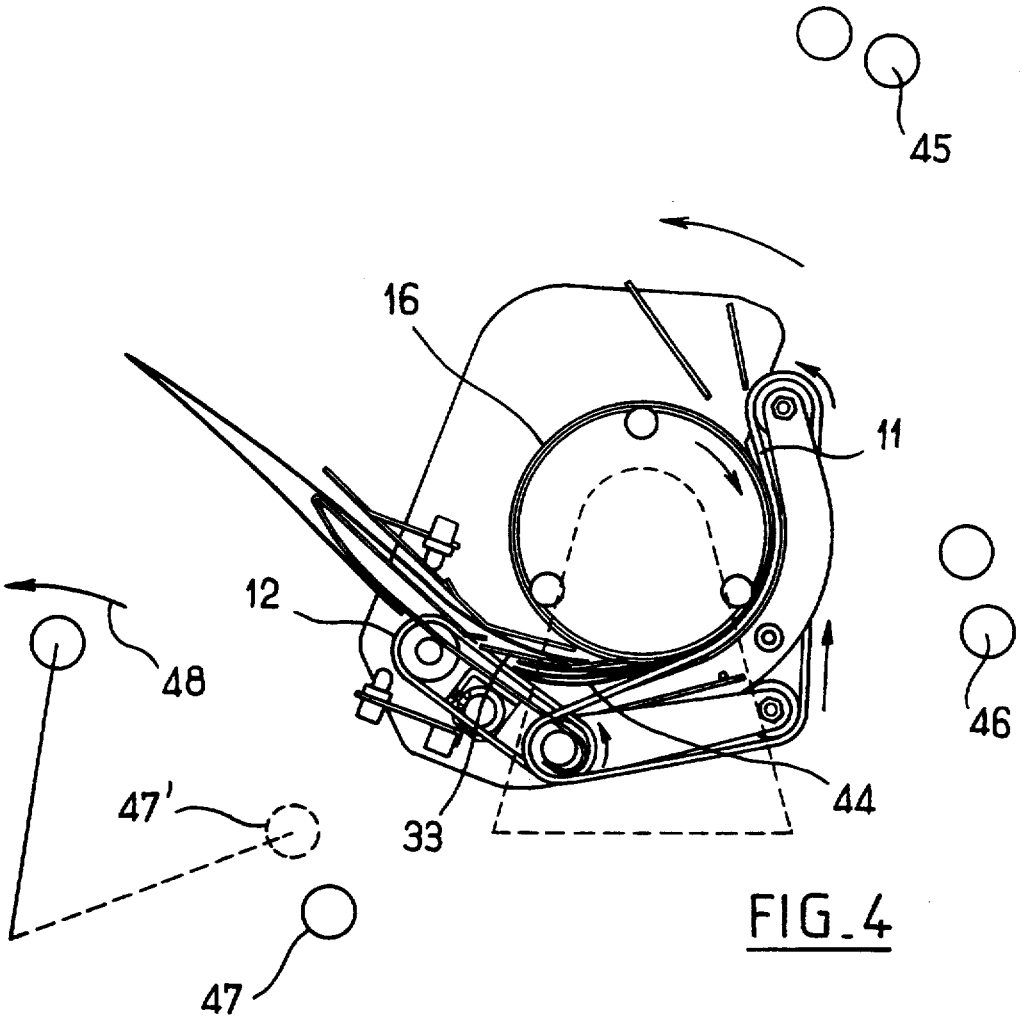

FIG. 4 shows the following step. When the document 44 has left the document delivering means 46, the microprocessor triggers the rotation of the whole rotating assembly. This rotation is obtained through the step motor 40 via the gears 41, 42. During rotation, the transfer of the document 44 goes on. The leading edge of the document leaves the area where the belts 11 and the drum 16 are tangent. Guided by the metal plate 33, the document 44 is then engaged by the belts 12. One of the rolls of an envelope discharging device comprised of two pressing rolls 47, 47' opens along the arrow 48 so as to prevent the envelope 43 from interfering with any part of the device.

Figure 5:
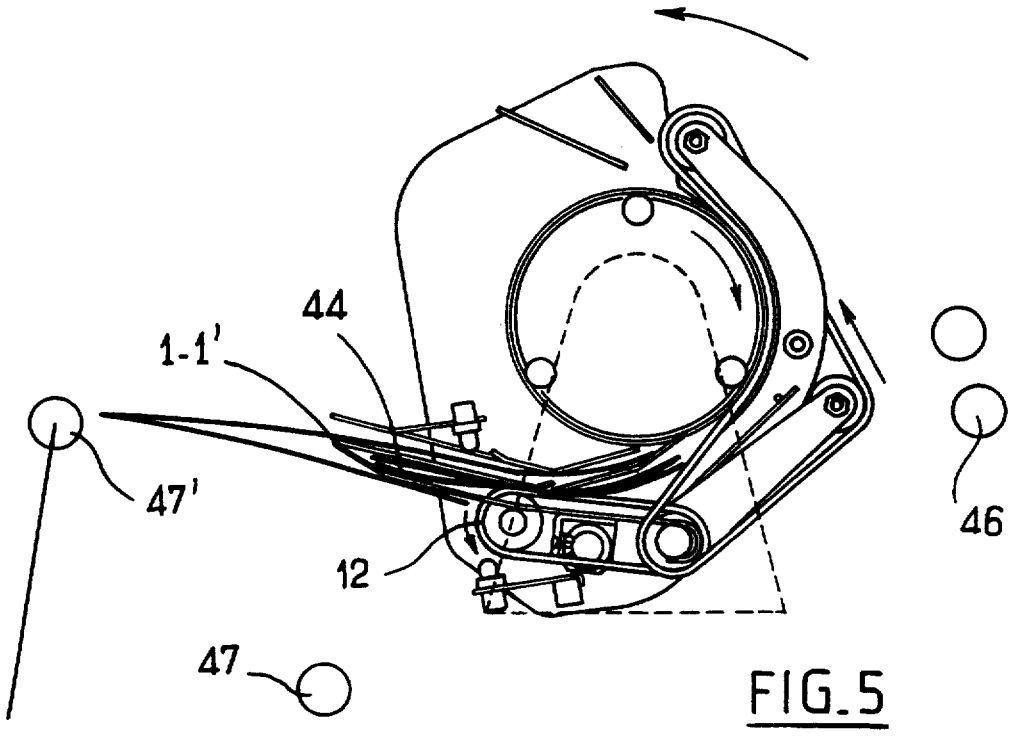

FIG. 5 shows the following step. The whole rotating assembly keeps rotating. The document 44, driven by the belts 12, slides within the fingers 1, 1' around which the envelope 43 is wrapped.

Figure 6:
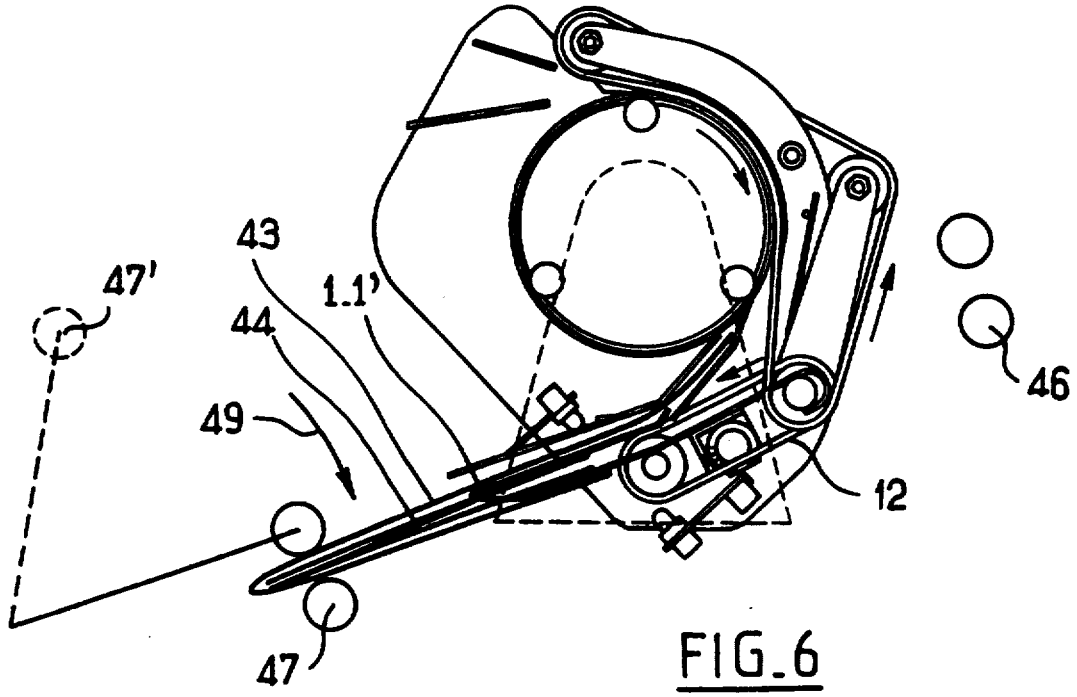

FIG. 6 shows the following step. The document 44 leaves the area of engagement with the belts 12 and enters, through inertia, totally in the envelope 43. The envelope discharging mechanism 47, 47' closes along the arrow 49. The microprocessor triggers a slight release of the fingers 1, 1' on the inner edges of the envelope.

Figure 7:
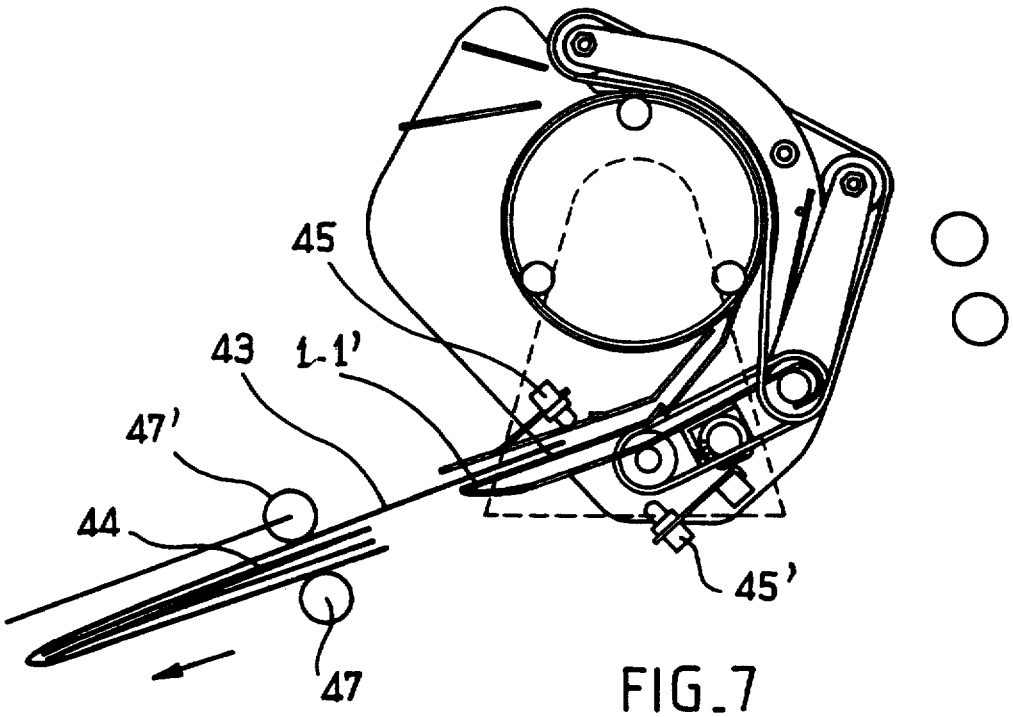

FIG. 7 shows the end step. The envelope discharging mechanism 47, 47' clamps (along the arrow 49) the envelope 43 containing the document 44 and removes it from fingers 1, 1'. A sensing cell 45, 45' senses the passage of the trailing edge of the envelope and sends a signal to the microprocessor for triggering the total unclamping of the fingers 1, 1'. When the envelope containing the document is fully engaged in the discharging device 47, 47', the microprocessor triggers the rotation of the inserter device back to its waiting inserting positions by means of the step motor 40.

What is claimed is:

1. An apparatus for inserting a document into an envelope, cooperating with document delivering means for delivering documents to the apparatus, envelope delivering means for delivering envelopes to the apparatus and envelope collecting means for collecting envelopes from the apparatus, the apparatus further comprising:

a rotating assembly displaceable between an envelope receiving position and an envelope discharging position, said rotating assembly comprising an envelope receiving station and a document receiving station as well as a transferring means for transferring a document between said document receiving station and said envelope receiving station, said envelope receiving station and said document receiving station being located respectively in front of the envelope delivering means and the document delivering means when said rotating assembly is in said envelope receiving position, said envelope receiving station being located in front of the envelope collecting means when said rotating assembly is in said envelope discharging position, control means being provided for achieving the following operation cycle:

a) said rotating assembly being in said envelope receiving position, the document delivering means and envelope delivering means are actuated, as well as said document transferring means between said document receiving station and said envelope receiving station, b) said rotating assembly rotates from said envelope receiving position to said envelope discharging position, while said transferring means is still operated, c) said rotating assembly being in the envelope discharging position, the envelope collecting means is operated, d) said rotating assembly is brought back to said envelope receiving position.

2. The apparatus of claim 1, wherein said document transferring means includes at least a set of endless belts cooperating with a drum.

3. The apparatus of claim 1, wherein said document receiving station includes fixed means for guiding said document towards said transferring means.

4. The apparatus of claim 1, wherein said envelope receiving station includes two moveable gripping and guiding fingers whose distance therebetween is controlled by said control means, and onto which the envelope delivering means engages an open envelope, said open envelope having then its inside located directly downstreams of said document transferring means.

5. The apparatus of claim 1, wherein at least a portion of the envelope collecting means can be shifted away during step b of said operating cycle.

* * * * *